US007926412B2

(12) United States Patent
Kristoff et al.

(10) Patent No.: US 7,926,412 B2
(45) Date of Patent: Apr. 19, 2011

(54) RETRACTABLE ASSEMBLY FOR ANALYTICAL MEASUREMENTS TECHNOLOGY

(75) Inventors: Kley Kristoff, Stuttgart (DE); Rainer Schlereth, Neuss (DE)

(73) Assignee: Endress + Hauser Conducta Gesellschaft für Mess- und Regeltechnik mbH + Co. KG, Gerlingen (DE)

( * ) Notice: Subject to any disclaimer, the term of this patent is extended or adjusted under 35 U.S.C. 154(b) by 606 days.

(21) Appl. No.: 12/000,221

(22) Filed: Dec. 11, 2007

(65) Prior Publication Data

US 2009/0272258 A1 Nov. 5, 2009

(51) Int. Cl.
*F01B 3/00* (2006.01)
*F01B 31/00* (2006.01)

(52) U.S. Cl. ..... 92/113; 92/181 R

(58) Field of Classification Search ..... 92/109, 92/113, 114, 181 R

See application file for complete search history.

(56) References Cited

FOREIGN PATENT DOCUMENTS

| | | | |
|---|---|---|---|
| DE | 38 20 405 | A1 | 8/1989 |
| DE | 91 15 171.6 | | 4/1992 |
| DE | 41 40 286 | C2 | 6/1993 |
| DE | 297 20 248 | U1 | 3/1998 |
| DE | 1979 20 504 | B4 | 11/1998 |
| DE | 102 41 833 | A1 | 3/2004 |
| DE | 10 2006 022 981 | A1 | 11/2007 |
| EP | 0 590 290 | A1 | 4/1994 |

*Primary Examiner* — Michael Leslie
(74) *Attorney, Agent, or Firm* — Bacon & Thomas, PLLC

(57) ABSTRACT

A retractable assembly, comprising: an assembly housing; a linear drive in the assembly housing; and a tubular holder), movably guided between a measuring position and a service position by means of the linear drive, for fluid-sealed reception of a sensor, with which a physical and/or chemical process variable is determinable. The linear drive includes a piston seated movably in a cylinder and loadable with a pressure-bearing medium on one or both ends and the tubular holder is fixed in the piston. The piston has on its working end active for the measuring position a breach in the direction of the interior of the tubular holder.

9 Claims, 2 Drawing Sheets

RETRACTABLE ASSEMBLY FOR ANALYTICAL MEASUREMENTS TECHNOLOGY

TECHNICAL FIELD

The invention relates to a retractable assembly having an assembly housing, a linear drive in the assembly housing and a tubular holder for fluid-sealing reception of a sensor for registering a physical and/or chemical, process variable, the tubular holder being guided for movement by means of the linear drive between a measuring position and a service position, wherein the linear drive includes a piston seated for movement in a cylinder and loadable on one or both ends by a pressure-bearing medium and the tubular holder is fixed in the piston.

BACKGROUND DISCUSSION

Retractable assemblies are widely used in analytical measurement technology. They serve for removing sensors, without process interruption, from the process, even at process pressures up to 10 bar and above, and for subsequently inserting sensors back into the process. In accomplishing these goals, the sensor is moved manually or automatically between the measuring position and the service position. In the service position, the sensor can be checked, calibrated, cleaned or replaced.

Especially in the case of automatically working retractable assemblies, in which case the sensor is moved by means of pressure-bearing air using a pneumatic linear drive, such being known, for example, from DE 10 2006 010 810 A1, there is the danger that, in the case of service, a sensor will be removed and then, subsequently, it will be forgotten to install a replacement sensor. If, then, the linear drive is activated, in order to shift the assembly into the measuring position, it is possible for process medium to escape through the now-open, tubular holder, in which the sensor is missing. The process medium can have a pressure of 10 bar and a temperature up to 140° C. Furthermore, the process medium can be chemically aggressive. A defective servicing of this type can lead to not insignificant accidents. Known from DE 102 41 833 A1 is a retractable assembly, in the case of which an axial movement of the immersion tube from the service position is prevented by means of a safety device, when the sensor is missing. For this, the retractable assembly must be equipped with additional structural features.

SUMMARY OF THE INVENTION

An object of the invention is to provide a retractable assembly, which can function without additional structural features and which, nevertheless, assures that the electrode guide cannot be shifted when no sensor is present.

This object is achieved according to the invention with a retractable assembly of the above-defined type, wherein the piston has on its working end active for the measuring position a breach in the direction of the interior of the tubular holder.

With the retractable assembly of the invention, movement of the piston in the case of a missing sensor is prevented in a simple manner, because the pressure-bearing medium cannot exert force on the piston, so that such is not moved. The pressure-bearing medium can have a positive or negative pressure, i.e. it can exert a push or a suction. In the following, the invention will be explained on the basis of a positive pressure, which should not, however, be understood as limiting to that particular case.

The working end of the piston active for the measuring position is located, in the case of use of pressurized air as the pressure-bearing medium, at the remote end of the sensor, or electrode, so that a pressure rise pushes the piston in the direction of the process medium and, in this way, the sensor is guided into the process medium. In the case of an empty tubular holder, i.e. in the case of a holder in which no sensor has been placed, the pressure-bearing medium can escape out of the working region via the breach, into the tubular holder and, from there, out into the environment. If pressurized air is used as the pressure-bearing medium, then this can flow out into the environment without worry. For hydraulic pressure-bearing media, for example, water can be used, which likewise can flow out into the environment without worry.

The retractable assembly of the invention has, accordingly, the significant advantage that, when the sensor is missing, the tubular holder does not move into the process medium. As a result, it is also not possible for process medium to escape, since the sealing closure on the end of the tubular holder is not opened.

In the case of a preferred form of embodiment, the breach is formed by at least one, especially by four, bores uniformly distributed over the periphery. These bores can be introduced relatively easily into the piston, as well as into the tubular holder.

In such case, in preferred manner, the cross section of the breach, especially the cross section of all bores, is greater than the cross section of the connector for the pressure-bearing medium into the relevant pressure chamber. In this way, it is achieved that no positive pressure can build-up in the pressure chamber, while the pressure-bearing medium is flowing out into the environment. Thus, in this case, the pneumatic resistance is greater at the connector than it is at the breach. If, in the relevant pressure chamber, a negative pressure is applied, sufficient air can be sucked-in from the environment.

As already mentioned, the linear drive can be a pneumatic drive or a hydraulic drive. Especially, environmentally-acceptable, pressure-bearing media are used for the linear drive.

In a further development, it is provided that the sensor end lying opposite to the electrode tip is secured fluid-sealedly in the holder. In such case, the sealing can be done, for example, with an O-ring. The pressure-bearing medium can, in such case, penetrate via the breach into the tubular holder, but not from there into the environment. In this way, a positive pressure (or, alternatively, a negative pressure) can be built-up in the relevant pressure chamber, whereby the piston is correspondingly moved. The sensor itself is designed to withstand this positive pressure (or negative pressure) without problem.

The sensor is, on the one hand, sealed in the tubular holder by means of a seal, especially by means of an O-ring, in the region of its electrode tip, while, on the other hand, the sensor is sealed by means of a further O-ring in the region of the piston, so that the pressure-bearing medium cannot escape in the direction of the process medium from between sensor and tubular holder. Moreover, the holder is sealed by means of a seal, especially an O-ring, in the piston, and the piston has an additional seal, via which it is sealed in the cylinder.

Further advantages, features and details of the invention will be apparent from the following description, in which an especially preferred example of an embodiment is described in detail with reference to the appended drawing. In such case, features shown in the drawing, as well as features mentioned in the claims or in the description, can be essential to the invention singly or in any combination.

DETAILED DISCUSSION

Figure 1:
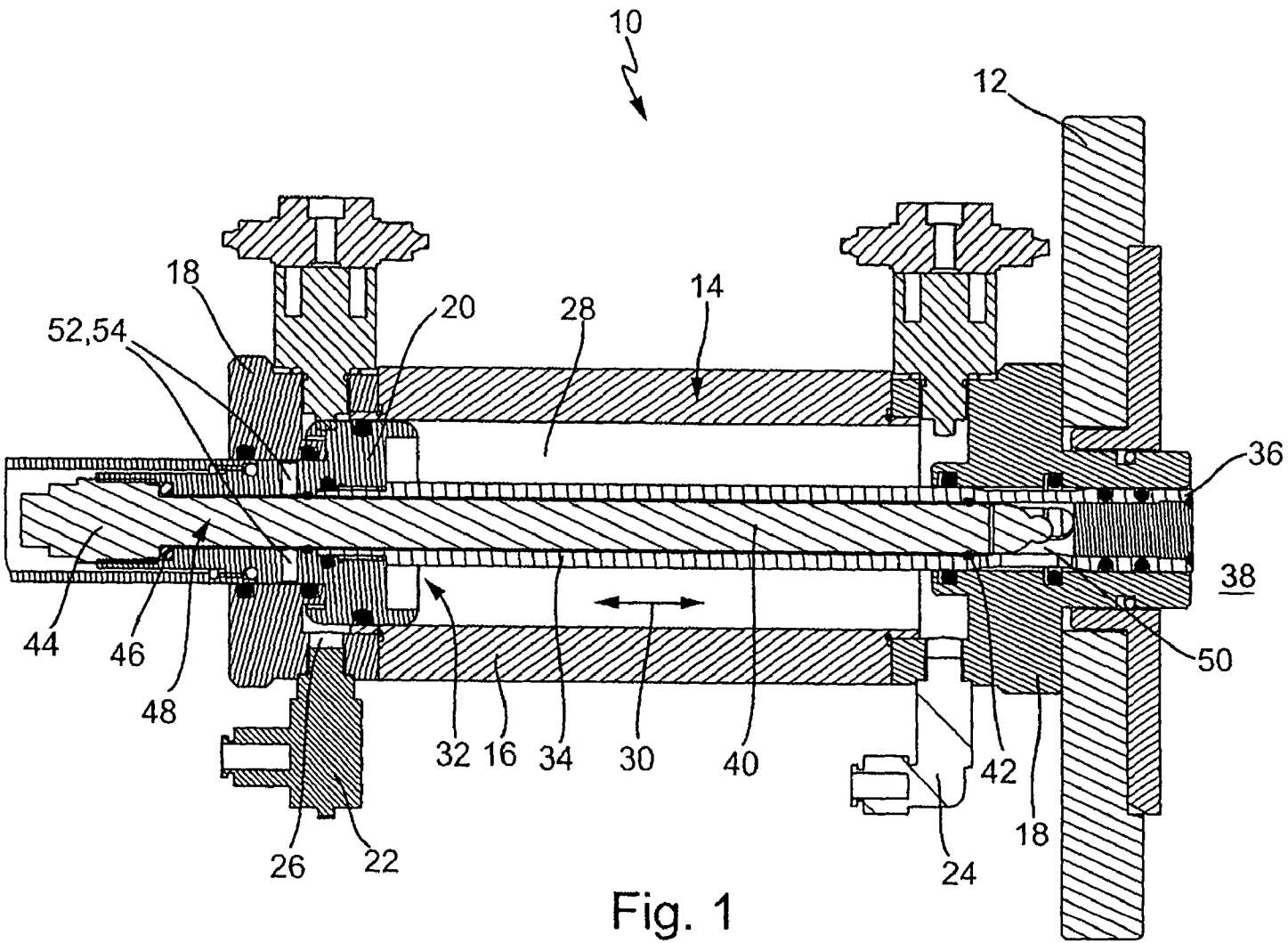
FIG. 1 is a longitudinal section through a retractable assembly, with sensor located in the service position.

FIG. 1 shows a longitudinal section through a preferred form of embodiment of a retractable assembly 10, which is secured on a flange 12, for example, by means of screws or bolts. Retractable assembly 10 includes an assembly housing 14, which is formed by, among other things, a cylinder 16, which is sealed terminally by end-caps 18. Located within cylinder 16 is a piston 20, which is loadable on both ends by pressurized air introducible via connectors 22 and 24 into pressure chambers 26 and 28 in front of and behind the piston 20. Piston 20 can also be loaded by a pressure-bearing medium only on one end, with retraction then being provided e.g. by a spring. This form of embodiment is not shown in the drawing. Cylinder 16 and piston 20 form a linear drive 32.

The invention will be described in the following on the basis of linear drive 32, with pressurized air being used as the pressure-bearing medium. Linear drive 32 can as well be operated with negative pressure in the pressure-bearing medium, in which case this negative pressure is then applied on the oppositely lying end of the piston 20.

Secured in piston 20 is a tubular holder 34, which passes through the flange-side floor 18 in a suitable opening and protrudes therefrom. At the free end 36, there are two O-rings, which assure a sealing closure of the tubular holder 34 in the floor 18. In this way, it is not possible for process medium 38, which contacts the side of the flange 12 lying opposite to the assembly housing 14, to penetrate into the retractable assembly 10 in the service position of the tubular holder 34 shown in FIG. 1.

Located in the tubular holder 34 is a sensor 40, with which physical and/or chemical, process variables of the process medium 38 can be determined. Sensor 40 is seated in the tubular holder 34 sealedly by means of an O-ring 42. On its oppositely lying end 44, the sensor is screwed into the piston 20 sealedly via a further seal 46. The electrode shaft 48 of the sensor 40 is sealed in the piston 20 by means of an O-ring.

For purposes of repair or maintenance, sensor 40 can be screwed out of the tubular holder 34 and, for example, be replaced by a new sensor 40. In such case, there is a danger that it will be forgotten to install a new sensor 40. If, then, inadvertently, by application of pressurized air at the connector 22, piston 20 is moved in the direction of the flange 12, then the tubular holder 34, absent sensor 40, is pushed out of the assembly housing 14 into the process medium 38. The free end 36 extends so far into the process medium 38 that the two sealing rings emerge and access to the sensor receiving space 58 in the tubular holder 34 is opened. In this case, process medium 38 could enter via the openings 50 provided in the tubular holder 34 into the receiving space 58 for the sensor 40 of the tubular holder 34, flow through the tubular holder 34, and exit at the oppositely lying end. Since the process medium 38 has a temperature up to 140° C. and can be under a pressure of up to 10 bar, this event can represent a significant danger.

Figure 2:
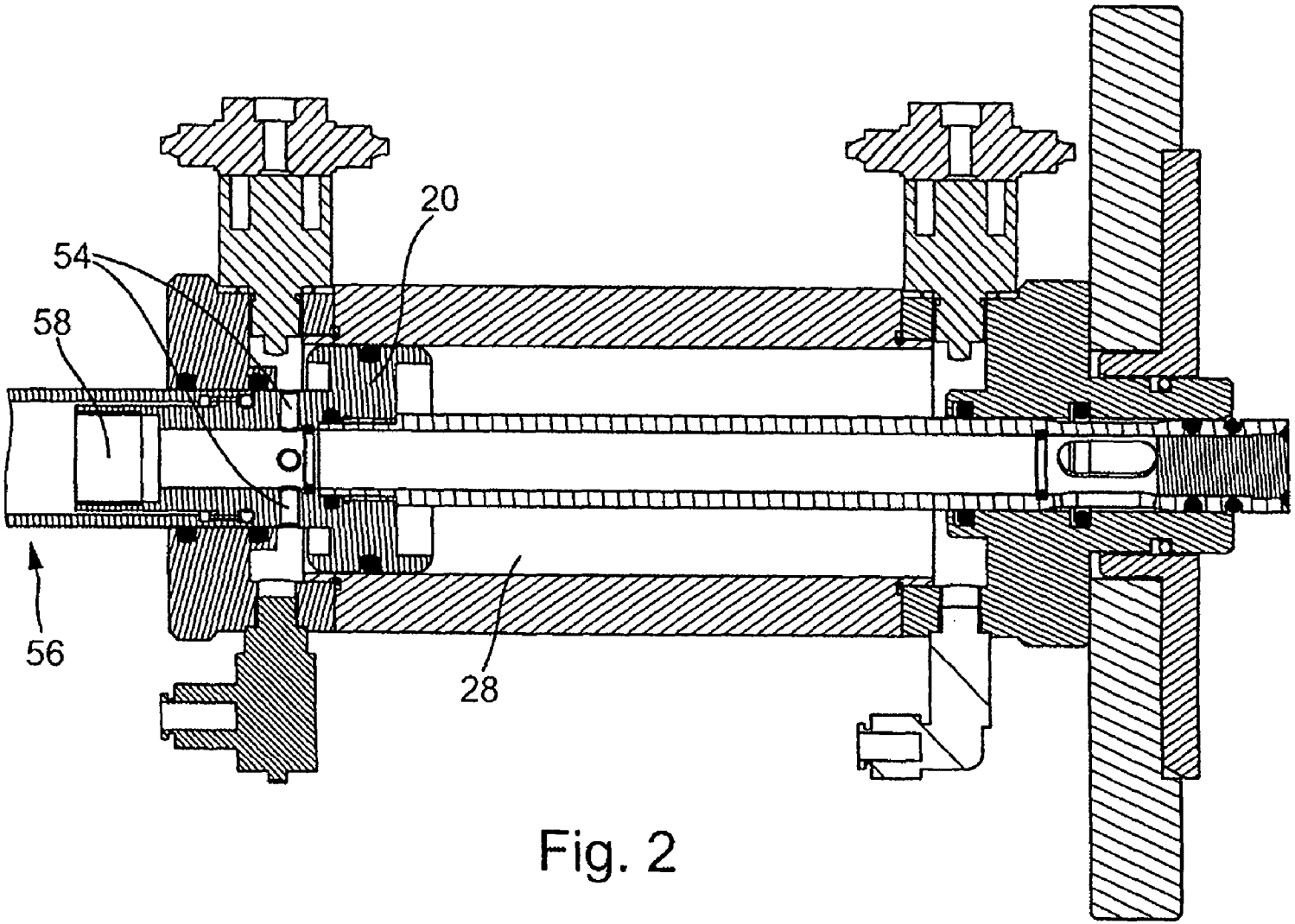
FIG. 2 is a view as in FIG. 1, without a sensor installed in the tubular holder.

In order to prevent this, piston 20 possesses, as shown in FIG. 2, a breach 52 in the form of the four traversing bores 54 arranged uniformly distributed around the periphery, via which the pressure chamber 26 is connected with the sensor receiving space 58 of the tubular holder 34. If, now, pressurized air flows via the connector 22 into the pressure chamber 26, the pressurized air can flow into the sensor receiving space 58 or cavity of the tubular holder 34 and from there into the environment, since no sensor 40 is present in the tubular holder 34 and, consequently, the tubular holder 34 is not sealed at its end lying opposite to the end 36.

The cross section of the transverse bores 54 is preferably greater than the cross section of the connector 22, so that the pneumatic resistance at the transverse bores 54 is less than at the connector 22. Since, in the pressure chamber 26, no pressure can build up, piston 20 remains in its position shown in FIG. 2. This means that the tubular holder 34 is not shifted, and especially, the free end 36 is not pushed out into the process medium 38. The free end remains sealed in the service position shown in FIG. 1.

FIG. 2 additionally shows a stroke tube 56, through which pressurized air escaping out of the pressure chamber 26 flows. The pressurized air can then escape from this stroke tube 56 at a suitable location, where a signaling device can be provided. The signaling device can signal acoustically and/or optically the escaping of the pressurized air, so that appropriate measures can be taken immediately.

The invention claimed is:

1. A retractable assembly, comprising:

an assembly housing formed by a cylinder;

a linear drive mounted in said assembly housing; and a tubular holder, movably guided between a measuring position and a service position by means of said linear drive, for fluid-sealed reception of a sensor, with which a physical and/or chemical process variable is determinable, wherein:

said linear drive includes a piston seated movably in said cylinder and loadable with a pressure-bearing medium on one or both ends;

said tubular holder is fixed in said piston;

an electrode shaft of the sensor is sealed in the piston by means of an O-ring;

said piston has on its working end active for the measuring position a breach in the direction of the interior of said tubular holder; and said breach comprises four traversing bores arranged uniformly distributed around the periphery, via which bores the pressure chamber is connected with a sensor receiving space inside the tubular holder.

2. The retractable assembly as claimed in claim 1, wherein:

the cross section of the breach is greater than the cross section of the connector for the pressure-bearing medium into the relevant pressure chamber.

3. The retractable assembly as claimed in claim 1, wherein:

said linear drive is a pneumatic drive or hydraulic drive.

4. The retractable assembly as claimed in claim 1, wherein:

the pressure-bearing medium has a positive pressure or negative pressure.

5. The retractable assembly as claimed in claim 1, wherein:

the sensor is secured in said holder fluid-sealedly on its end lying opposite to its electrode tip.

6. The retractable assembly as claimed in claim 1, wherein:

said holder is sealed in said piston by means of a seal.

7. The retractable assembly as claimed in claim 6, wherein:

the seal lies in the direction of the process side.

8. The retractable assembly as claimed in claim 5, wherein:

the sensor is screwed into said holder fluid-sealedly on its end lying opposite to its electrode tip.

9. A retractable assembly, comprising:

an assembly housing formed by a cylinder;

a linear drive mounted in said assembly housing; and a tubular holder, movably guided between a measuring position and a service position by means of said linear drive, wherein:

said linear drive includes a piston seated movably in said cylinder and load-able with a pressure-bearing medium on one or both ends;

a sensor being sealedly seated in said tubular holder by means of an O-ring;

one end of said sensor is screwed into the piston sealedly via a further seal;

said tubular holder is fixed in said piston and sealed into the piston via an O-ring seal;

an electrode shaft of the sensor is sealed in the piston by means of an O-ring and said piston has on its working end active for the measuring position a breach in the direction of the interior of said tubular holder; and said breach comprising four traversing bores arranged uniformly distributed around the periphery, via which bores the pressure chamber is connected with a sensor receiving space inside the tubular holder.

* * * * *